US009717306B2

(12) United States Patent
Sanchez et al.

(10) Patent No.: US 9,717,306 B2
(45) Date of Patent: Aug. 1, 2017

(54) CLEAT ASSEMBLY FOR AN ATHLETIC SHOE AND AN ATHLETIC SHOE COMPRISING SAME

(71) Applicants: Hernan Sanchez, Carmel, NY (US); Laurence Piturro, Mount Kisco, NY (US)

(72) Inventors: Hernan Sanchez, Carmel, NY (US); Laurence Piturro, Mount Kisco, NY (US)

( * ) Notice: Subject to any disclaimer, the term of this patent is extended or adjusted under 35 U.S.C. 154(b) by 0 days.

(21) Appl. No.: 14/807,099

(22) Filed: Jul. 23, 2015

(65) Prior Publication Data

US 2016/0021981 A1 Jan. 28, 2016

Related U.S. Application Data

(60) Provisional application No. 62/027,861, filed on Jul. 23, 2014.

(51) Int. Cl.

| | |
|---|---|
| ***A43C 13/04*** | (2006.01) |
| ***A43C 15/16*** | (2006.01) |
| ***A43B 5/00*** | (2006.01) |
| ***A43B 13/26*** | (2006.01) |
| ***A43C 15/02*** | (2006.01) |

(52) U.S. Cl.

CPC ..... *A43C 15/168* (2013.01); *A43B 5/00* (2013.01); *A43B 13/26* (2013.01); *A43C 13/04* (2013.01); *A43C 15/02* (2013.01); *A43C 15/16* (2013.01)

(58) Field of Classification Search

CPC ..... A43C 13/04; A43C 15/16; A43C 15/168

USPC ..... 36/61, 134, 27, 28, 67 R, 67 D

See application file for complete search history.

(56) References Cited

U.S. PATENT DOCUMENTS

| | | | | |
|---|---|---|---|---|
| 554,988 A | | 2/1896 | Cushing | |
| 2,383,267 A | * | 8/1945 | Malmqvist | A43C 13/04 135/77 |
| 3,496,656 A | * | 2/1970 | Caine | A43B 5/00 219/121.12 |
| 3,631,614 A | * | 1/1972 | Rice | A43C 15/14 36/61 |
| 3,739,499 A | * | 6/1973 | Morin | A43B 5/001 12/142 P |
| 4,159,582 A | * | 7/1979 | Ostrowski | A43C 15/14 36/134 |
| 4,470,207 A | * | 9/1984 | Bente | A43C 15/168 36/134 |
| 4,660,299 A | * | 4/1987 | Omilusik | A43B 13/182 36/27 |

(Continued)

FOREIGN PATENT DOCUMENTS

| | | |
|---|---|---|
| GB | 2257616 | 1/1993 |
| WO | 00/53047 | 9/2000 |

(Continued)

*Primary Examiner* — Marie Bays

(74) *Attorney, Agent, or Firm* — Carmody Torrance Sandak & Hennessey LLP

(57) ABSTRACT

An athletic shoe comprising an upper portion; a sole; and a cleat assembly comprising a base for coupling to the sole, wherein the cleat assembly includes a post assembly having a biasing member; and a cleat body, wherein the cleat body is disposed on the post assembly; wherein the post assembly has 360° tiltability, relative to the sole; wherein the cleat body also has 360° tiltability, relative to the sole. A cleat assembly for an athletic shoe is also provided.

6 Claims, 11 Drawing Sheets

(56) References Cited

U.S. PATENT DOCUMENTS 4,698,924 A * 10/1987 Greiner ..... A43C 15/167 36/134
4,715,130 A * 12/1987 Scatena ..... A43B 21/30 36/27
5,289,647 A * 3/1994 Mercer ..... A43C 15/168 36/134
5,351,422 A * 10/1994 Fitzgerald ..... A43B 5/001 36/134
5,361,518 A * 11/1994 Sussmann ..... A43C 15/167 36/134
5,377,431 A 1/1995 Walker et al.
5,505,012 A * 4/1996 Walker et al. ..... A43C 15/168 36/134
6,079,127 A * 6/2000 Nishimura ..... A43C 15/14 36/134
6,481,122 B2 * 11/2002 Brahler ..... A43C 15/165 36/127
6,739,075 B2 * 5/2004 Sizemore ..... A43B 13/182 36/61
7,430,819 B2 * 10/2008 Auger ..... A43C 15/14 36/134
8,256,145 B2 9/2012 Baucom et al.
8,453,349 B2 6/2013 Auger et al.
8,533,979 B2 9/2013 Baker
8,584,380 B2 * 11/2013 Auger ..... A43C 15/168 36/134
2002/0083616 A1 * 7/2002 Hajianpour ..... A43B 13/182 36/7.8
2003/0033731 A1 * 2/2003 Sizemore ..... A43B 13/182 36/28
2006/0130372 A1 * 6/2006 Auger ..... A43C 15/14 36/134
2007/0251128 A1 * 11/2007 Yen ..... A43C 15/161 36/134
2009/0211118 A1 8/2009 Krikorian et al.
2011/0203136 A1 * 8/2011 Auger ..... A43C 15/168 36/61
2011/0225842 A1 * 9/2011 Lu ..... A43B 21/26 36/27
2012/0174441 A1 7/2012 Jungkind
2013/0160328 A1 6/2013 Hatfield et al.
2014/0310995 A1 * 10/2014 Campari ..... A43C 15/161 36/134
2016/0021981 A1 * 1/2016 Sanchez ..... A43B 5/00 36/134

FOREIGN PATENT DOCUMENTS

WO 03/071893 9/2003
WO 2010/057207 5/2010
WO 2010/088337 8/2010
WO 2014/018879 1/2014

* cited by examiner

CLEAT ASSEMBLY FOR AN ATHLETIC SHOE AND AN ATHLETIC SHOE COMPRISING SAME

This application claims the benefit of and priority to provisional application Ser. No. 62/027,861, filed Jul. 23, 2014, the subject matter of which is incorporated by reference in its entirety.

BACKGROUND OF THE INVENTION

This invention relates generally to athletic shoes and cleat assemblies therefor, and in particular to an improved cleat assembly for an athletic shoe that provides the person(s) wearing said shoe with the ability to adjust to specific movements and/or situations, thereby minimizing the stress and impact on muscles, joints and ligaments and enhancing the performance and the well-being of the athlete(s) and/or person(s) wearing the athletic shoe with the cleat assembly disclosed herein.

Generally speaking, in sports such as soccer, baseball, football, rugby, etc., a lot of stress and strain is placed upon the player's foot and footwear, thus resulting in a lot of strain and stress on the player's joints, muscles and ligaments. Such players also perform various movements which includes starting, stopping, turning, cutting, planting and landing in various positions, just to name a few.

Frequent athletic injuries are the result of trauma brought about by torsion of the leg. This trauma typically occurs at the time of pivotal rotation when the foot is stationary. Injuries can vary from damage to the knee's cartilage and ligaments to fractures of the tibia bone. It is believed that many of the injuries are linked to the interaction between the playing surface and the athlete's shoe.

For example, adhesion to the playing surface (e.g. natural grass or turf) is important and should be considered both in translation and rotational. It is therefore important to achieve optimum adhesion, not necessarily at maximum. For example, the friction coefficient in translation must be high enough to allow acceleration and the rapid changes of direction required for high performance, yet the adhesion in rotation must be the lowest possible in order to avoid breakage of the shoe at the time of a rotation.

It has also been found that players injure their muscles, joints and ligaments during aggressive athletic endeavors.

It would be desirous to provide a cleat assembly for an athletic shoe that minimizes the likelihood of injuries, minimizes the severity of such injuries and provides an opportunity to recover quickly from any awkward stops, starts, cuts, landings, etc.

Accordingly, an improved cleat assembly for an athletic shoe that overcomes the drawbacks found in the prior art while at the same time achieves the advantages and objectives, as set forth herein, is desired.

SUMMARY AND OBJECTIVES OF THE PRESENT INVENTION

Accordingly, it is an object of the present invention to overcome the deficiencies in the prior art.

Another objective of the present invention is to provide athletes and other persons with the ability to adjust to specific movements on an athletic field, while simultaneously minimizing stress and impact on muscles, joints and ligaments.

Still another objective of the present invention is to enhance the performance and the well-being of the wearer of athletic shoes.

Still another objective of the present invention is to provide customizable cleat assemblies and/or customizable shoes in which the flexibility and degree of flexing of the cleat assembly can be tailored to meet the optimal needs of the user.

Yet another objective of the present invention is providing an improved athletic shoe that will improve and extend the athletic career of an athlete.

Still another objective of the present invention is to provide an improved athletic shoe that will prevent and/or at least minimize foot and ankle injuries.

Yet another objective of the present invention is to provide an improved athletic shoe that will absorb forces generated by the player without sacrificing desired traction.

Still another objective of the present invention is to provide an improved athletic shoe that will reduce the force applied to the joints of the extremities of the player.

Yet another objective of the present invention is to provide an improved athletic shoe that will, in particular, prevent and/or at least minimize risk of injury of a knee.

Still further, another objective of the present invention is to provide an improved athletic shoe that will reduce the impact and stress in the lower and upper back muscles.

Yet another objective of the present invention is to provide an improved athletic shoe that will assist in preventing and/or at least minimizing injuries, tearing and inflammation in ligaments and muscles such as achilles, heel, plantar-faschiatis, hamstrings, gluteus, soleus, biceps femorus, tibialis anterior, adductor-congrus, rectus-femorus, sartorius, pectineus and lastus laterallis.

Yet another objective of the present invention is to provide improved opportunities to recover more quickly from any awkward stops, starts, cuts, landings, etc. than currently available in the prior art.

Still other objects and advantages of the invention will in part be obvious and will in part be apparent from the specification.

The invention accordingly comprises the features of construction, combination of elements, sequence of steps and arrangement of parts which will be exemplified in the construction and methodologies hereinafter set forth, and the scope of the invention will be indicated in the claims.

Therefore, the present invention, in accordance with a first preferred embodiment, is generally directed to an athletic shoe comprising an upper portion; a sole; and a cleat assembly comprising a base that is coupleable to the sole, wherein the cleat assembly comprises a post assembly comprising a biasing member; and a cleat body, wherein the cleat body is disposed on the post assembly; wherein the post assembly has 360° tiltability, relative to the sole; and wherein the cleat body also has 360° tiltability, relative to the sole based on the cleat body being disposed on the post assembly.

In differing specific embodiments, the base of the cleat assembly may comprise a threaded post, and the cleat assembly is coupled to the sole by the threaded post that threadably engages a complementary receptacle in the sole. Alternatively, the base of the cleat assembly may be molded to the sole.

Cleat assemblies for an athletic shoe are also provided.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
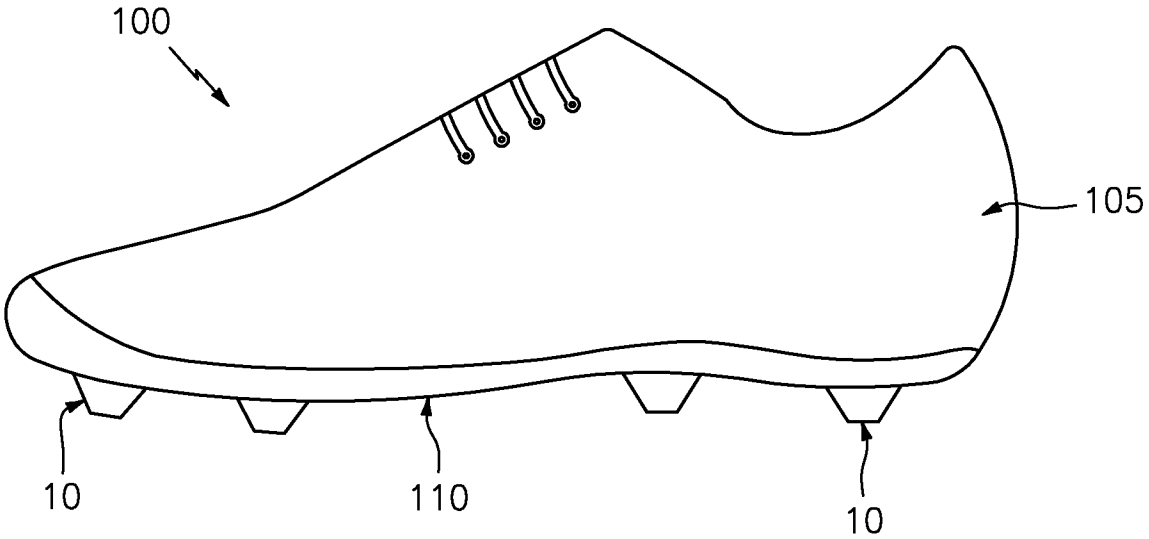
FIG. 1 illustrates an athletic shoe constructed in accordance with preferred embodiments of the present invention.

Generally speaking, the advantages and objectives set forth above and disclosed below are achieved in part by the unique construction of a cleat assembly in accordance with preferred embodiments of the present invention, which, as will be more fully disclosed below, will have the ability to flex, move, and tilt in a full 360 degrees. For purposes of understanding of the present invention, it should be understood that the terms "flex" and/or "tilt" (and forms thereof, e.g. "tiltability") may all be used interchangeably. Reference to one term vs. another should not in any way be deemed to alter the scope of the claims or the disclosure herein.

The preferred embodiments of the present invention work in synergy with the body of the athlete. The uniqueness of this concept is the ability to move and adapt to the athletes direction in which he or she makes a sudden change of direction or force which is created on the surface in conjunction of the g-force. The athlete at a specific moment or movement creates the ability to absorb the stress and the pressure generated by the speed and intensity which minimizes the stress and tension in the ligaments and muscles of the athlete without a breaking point.

At the same time, when the g-force and direction is released, the present invention provides for the absorption of the muscle elongation (joint/ligament/muscle extension, lengthening, stretching) impact over the body, retracting to its original position and thus minimizing the stress and damage athletes body.

Generally speaking, the preferred embodiments herein comprise a cleat assembly that comprises a post assembly, which is itself comprised of a flexible material. The cleat assembly may be removeably coupled to the soul of the shoe or molded thereto, as will be disclosed herein. The cleat assembly further comprises a cleat body that is preferably disposed on the post assembly. The cleat body may be overmolded onto the post assembly or disposed thereon by adhesive, melting or otherwise and would be understood in the art. Overmolding of the cleat body onto the post assembly will make the cleat body and the post assembly appears more like a unitary/integral unit.

The cleat body is likewise preferably made up of a long lasting flexible material, such as a gel, silicone, rubber and/or polyurethane material, or a combination thereof.

The post assembly as disclosed herein advantageously acts as both an absorber as well as a retractor, thereby being able to tilt in a 360° fashion. As used herein, the term "tilt" can be understood to be similar to a slight sway in the cleat body, which is due to the spring action of the spring incorporated into the post assembly as disclosed herein. The tilt can be in any, each and every direction (i.e. "360° tiltability"), which is depicted by the arrows in FIGS. 7A-7D. It should be understood that the illustrations of FIGS. 7A-7D illustrate the cleat body tilting in one direction, but the arrows should be understood to illustrate that the post assembly and cleat head could tilt in the opposite direction from that shown, in the directions "in" and "out" of the page and at each and every angle therebetween, which will be dictated by the movement of the foot, as discussed herein. The tiltability is significantly more exacting and controlled than as illustrated herein for exemplary purposes.

The post assembly preferably is comprised of the best suitable material in the market, for example and not limitation, rubber, titanium, a polymer blend and/or a combination thereof, and/or any other material that allows flexibility, elasticity and strength as well any materials that can withstand extreme heat and or extreme cold.

The embodiments of the present invention are adaptable to all terrains such as snow, mud, rain, grass, artificial grass, turf and dirt. The materials that are being combined to produce the preferred embodiments have the ability to withstand different types of pressures from all different angles and degrees of difficulty. For example, a post assembly as constructed herein provides for the correct, if not precise, amount of flexibility, being both measurable and balanced.

As will be disclosed below, there are at least two embodiments of the cleat assembly. Namely, a first embodiment in which the cleat assembly is to be provided with a threaded post for releasably fastening to the sole, and a second embodiment in which the cleat assembly is molded to the sole of the shoe.

Preferably, the biasing member is embedded in the post assembly, overmolded therewith or wrapped by the flexible post material. In any of these embodiments, the post assembly thus provides a cleat assembly that is fully functional, provides the improved functionality as set forth herein, and at the same time is extremely durable.

Reference is now also made to the figures for even a further complete disclosure of preferred embodiments of the present invention.

As illustrated therein, in a first embodiment, the present invention is generally directed to a cleat assembly, generally indicated at 10, and an athletic shoe, generally indicated at 100, comprising such a cleat assembly 10.

Figure 7A:
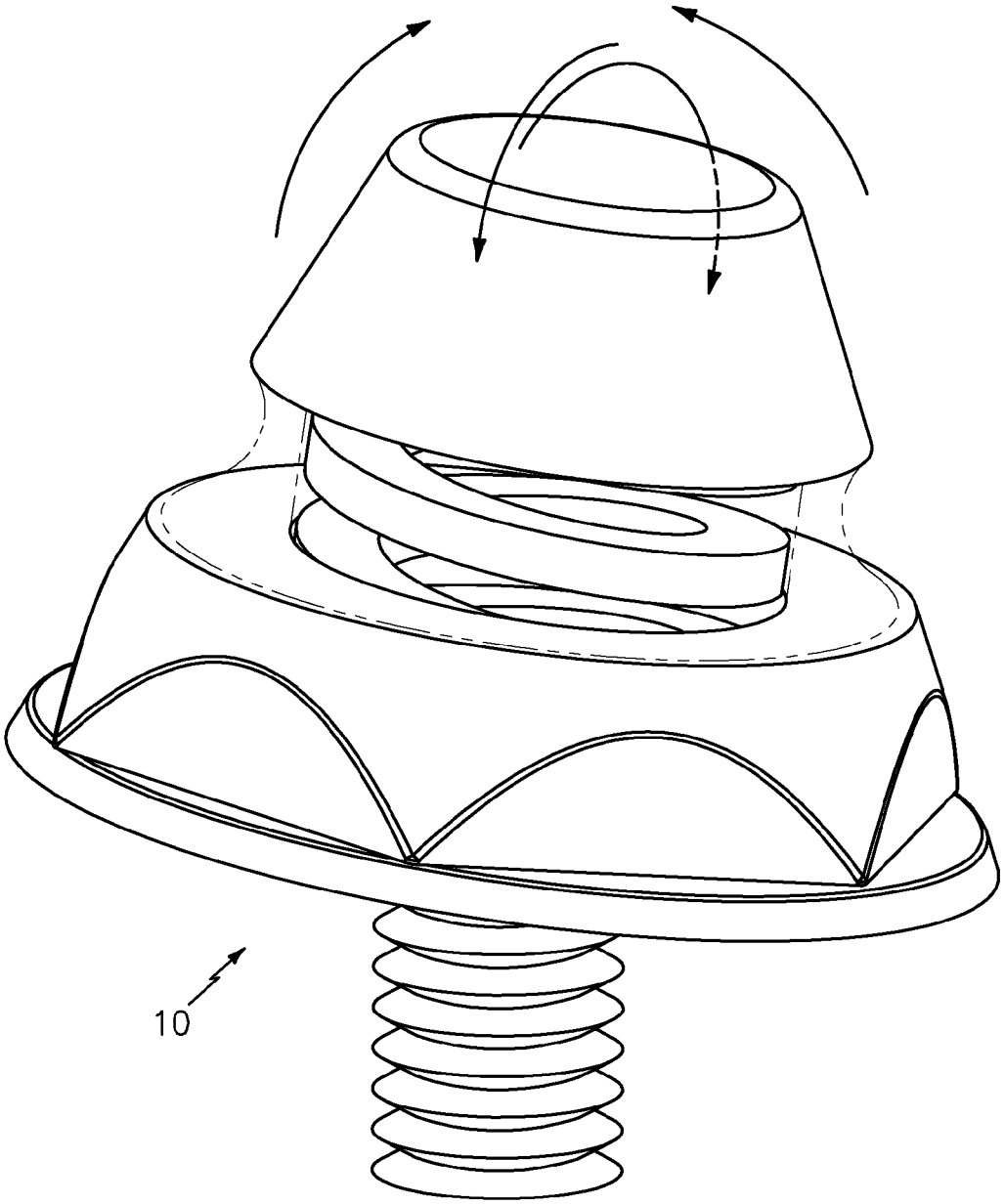
FIGS. 7A, 7B, 7C and 7D illustrate the feature of the 360° arc, to illustrate the advantageous rotational and tiltability of each and every cleat assembly embodiment of the present invention.
Figure 7B:
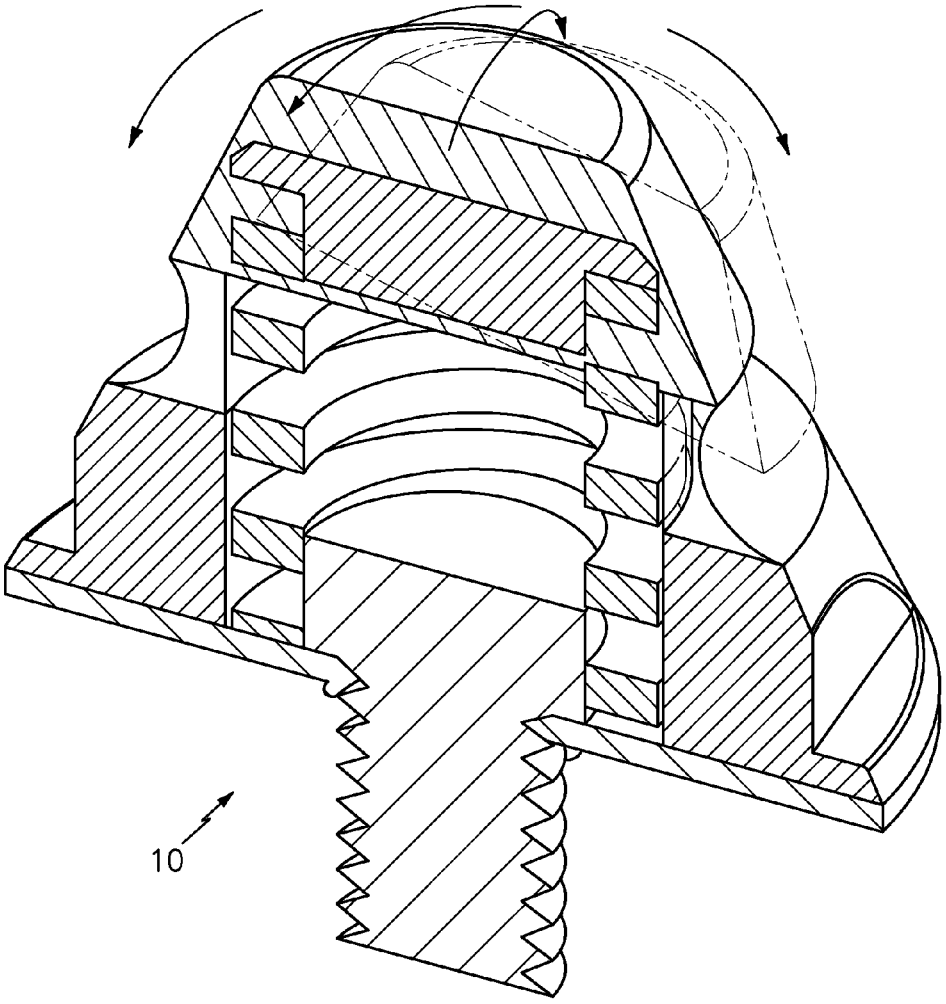

In a first embodiment, the athletic shoe 100 may comprise an upper portion generally indicated at 105, a sole generally indicated at 110 and cleat assembly generally indicated at 10. Cleat assembly 10 is coupleable to the sole 110. Cleat assembly 10 comprises a post assembly generally indicated at 20, which itself comprises a biasing member 30, which is preferably a spring. In this way and as disclosed with reference to FIGS. 7A, 7B, the post assembly has 360° tiltability, relative to the sole of the shoe. Cleat assembly 10 also comprises a cleat body 40, wherein the cleat body 40 is disposed on the post assembly 20. In view thereof, and with cleat body 40 on post assembly 20, the cleat body 40 also has 360° tiltability, relative to the sole of the shoe, as depicted in FIGS. 7A, 7B. The tilting i.e. movement of the post assembly 20 and hence the cleat assembly in the 360 degree fashion as disclosed herein is due to the incorporation of spring 30 in the post assembly.

For purposes of further disclosure and best understanding, by reference to 360° tiltability it is meant that the post assembly 20, because of the spring 30, can flex in 360°s of direction, and therefore, cleat body 40, which is on post assembly 20, can also flex (i.e. tilt) in the same 360° fashion. This can best be illustrated in FIGS. 7A-7D, which illustrates the full flexibility i.e. tiltability, rotation and/or movement that can be imparted to post assembly 20, and in turn cleat body 40 as being mounted thereon. It should also be understood that because of the post assembly 20 with the spring 30 therein, cleat body 40 can also flex in the vertical i.e. up/down direction relative to the shoe bottom. In any event, none of the prior art shoes or cleat assemblies provide for the 360° tiltability and flexing as claimed and disclosed herein. Therefore, in a specific embodiment of the present invention, the cleat body may also be moveable vertically relative to the sole of the shoe, while at least being able to tilt relative to the sole as disclosed herein in accordance with the present invention.

Figure 2:
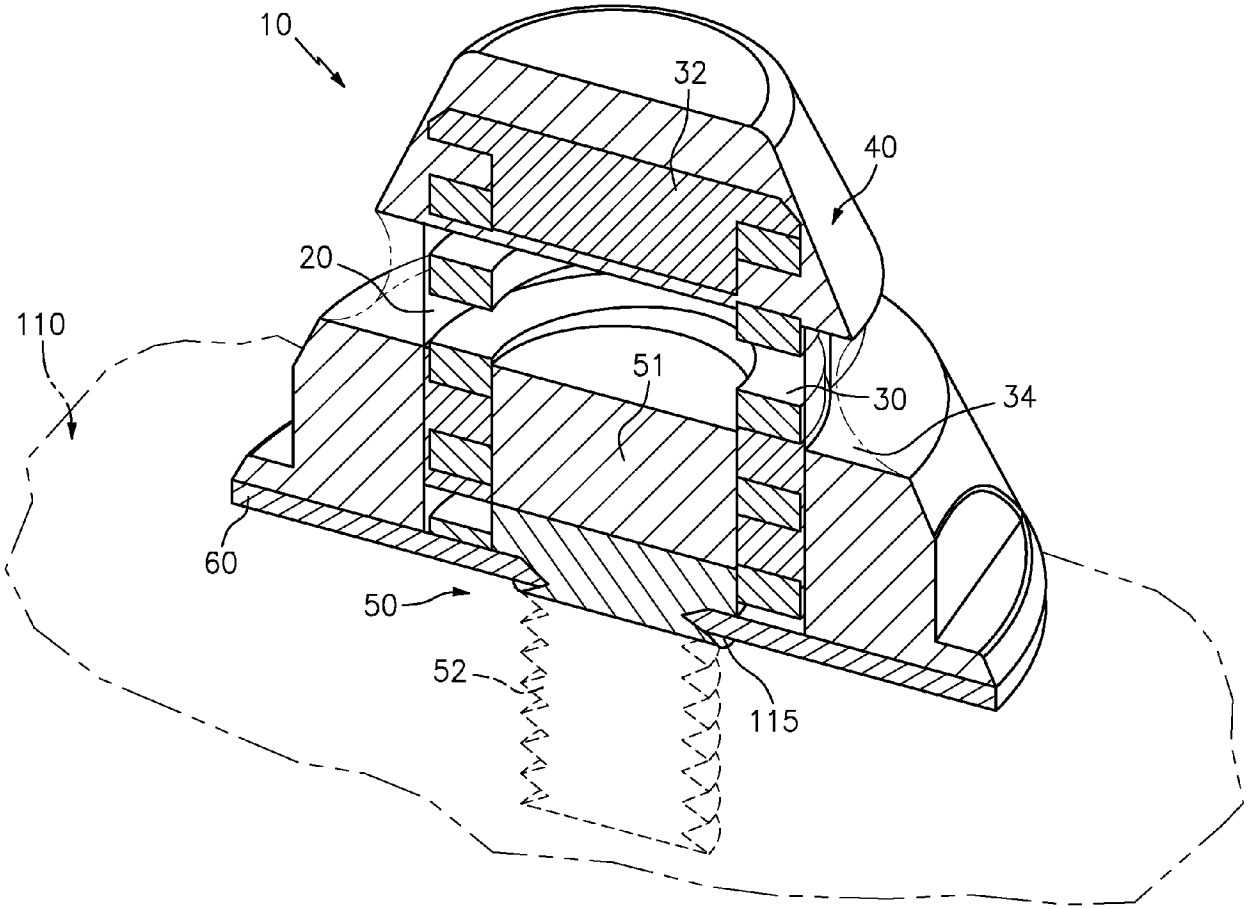
FIG. 2 is a cross-sectional view of a preferred embodiment of a cleat assembly constructed in accordance with the present invention, illustrating an embodiment comprising a threaded post for coupling to the sole of the athletic shoe.

In the preferred embodiments, the cleat assembly 10 also comprises a base, generally indicated at 50. In a specific embodiment, the cleat assembly 10 is coupled to the sole by the base 50, which comprises a head 51 and a threaded post 52 that threadably engages a complementary receptacle 115 in the sole 110 (see FIGS. 2, 3). The dotted portions of post 52 in FIG. 2 are meant to illustrate the portion of the base 50 below the surface of the sole 110. A flexible ring 60 may also be provided between cleat body 40 and the surface of the sole 110 to provide for further cushioning of the athlete's foot. This flexible ring 60 may also be provided with the embodiment of FIGS. 4 and 5 if desired.

Figure 4:
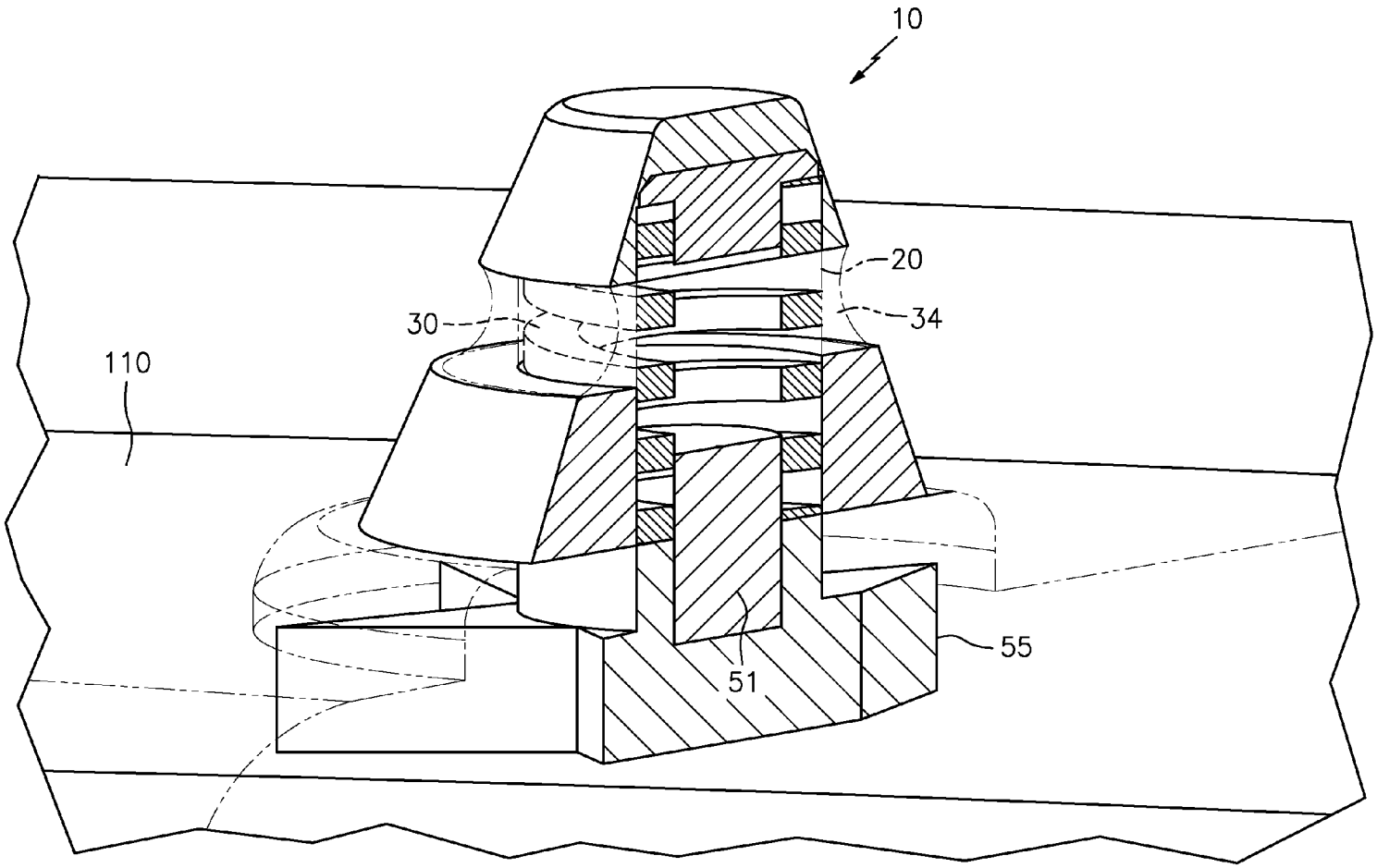
FIG. 4 is a cross-sectional view of another preferred embodiment of a cleat assembly constructed in accordance with the present invention, illustrating an embodiment in which the cleat assembly is molded to the sole of the athletic shoe.
Figure 5:
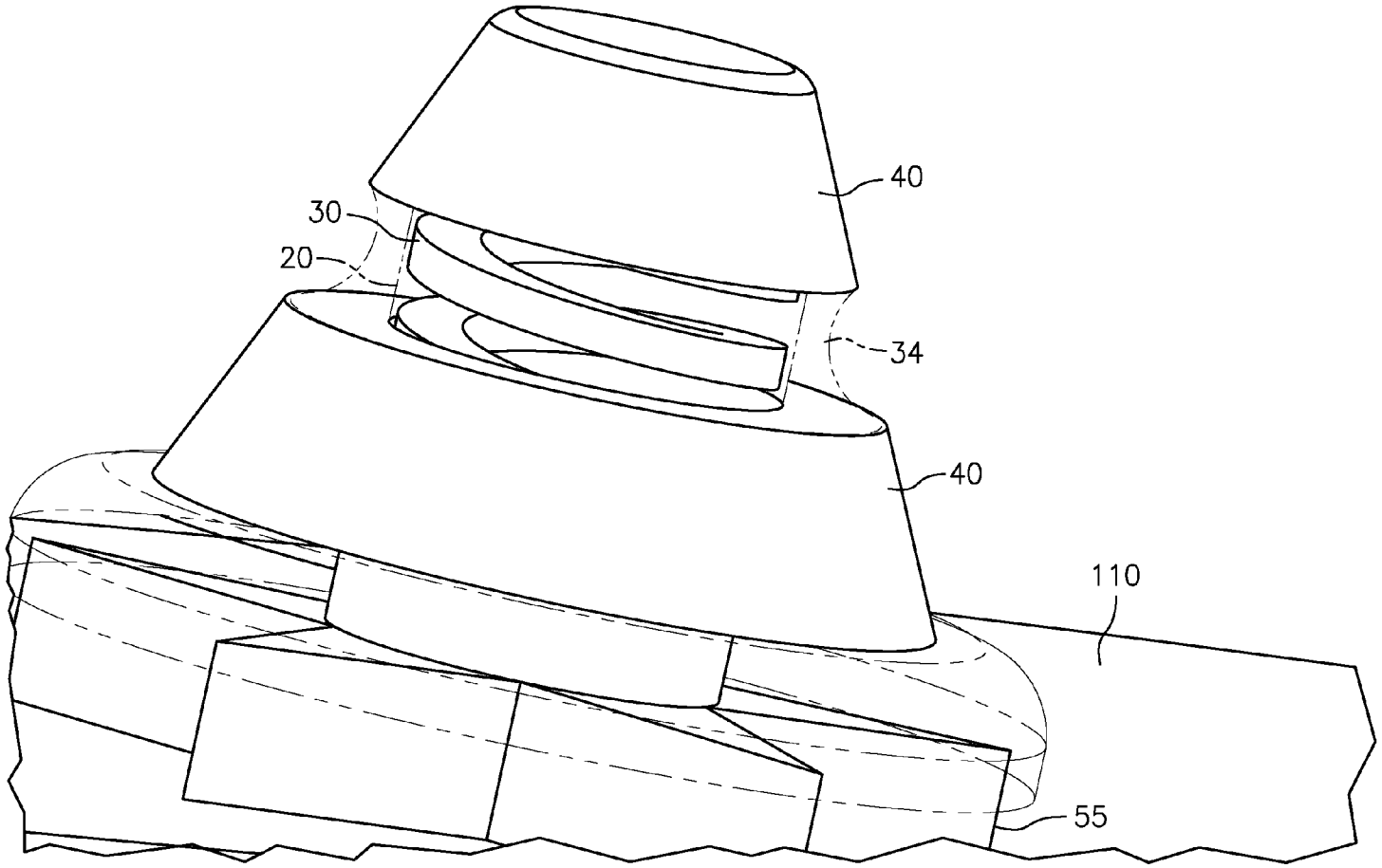
FIG. 5 is a cross-sectional view of the cleat assembly of FIG. 4.
Figure 7C:
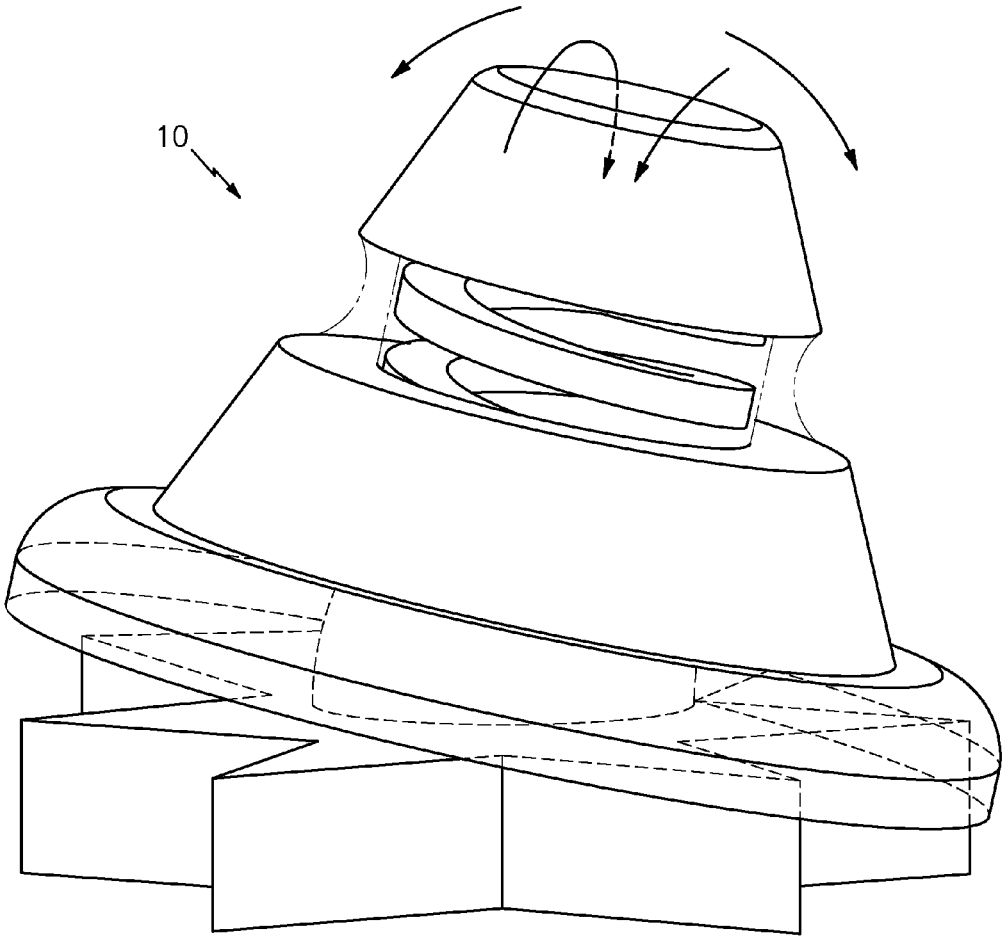
Figure 7D:
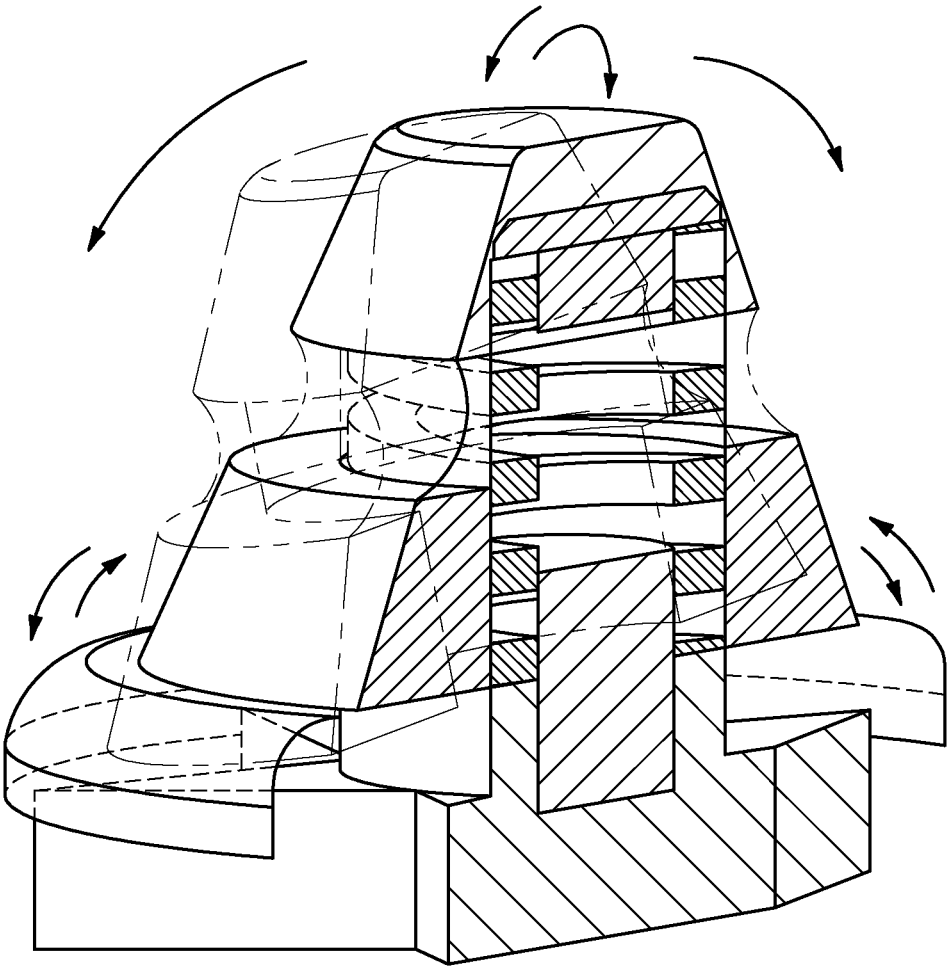

Alternatively, and as illustrated in FIGS. 4, 5, the base 50 merely comprises the head 51, which in turn may be molded to the sole 110 of the shoe 100 in a manner known to those skilled in the art. For example, a molded coupler 55 may be provided to secure cleat assembly 10 to sole 110. For example, the head 51 of base 50 is received in a receptacle of coupler 55, as illustrated in FIGS. 4, 5. As should now also be understood and as illustrated in FIGS. 7C, 7D, the cleat assembly 10 of FIGS. 4 and 5 also provides a post assembly with 360° tiltability, relative to the sole of the shoe, due to the incorporation of spring 30. Similarly, cleat body 40 also has 360° tiltability, relative to the sole of the shoe, as depicted therein. The tilting i.e. movement of the post assembly 20 and hence the cleat assembly in the 360 degree fashion in this embodiment is likewise due to the incorporation of spring 30 in the post assembly, which can flex inside the post assembly of each cleat assembly disclosed herein.

Figure 6A:
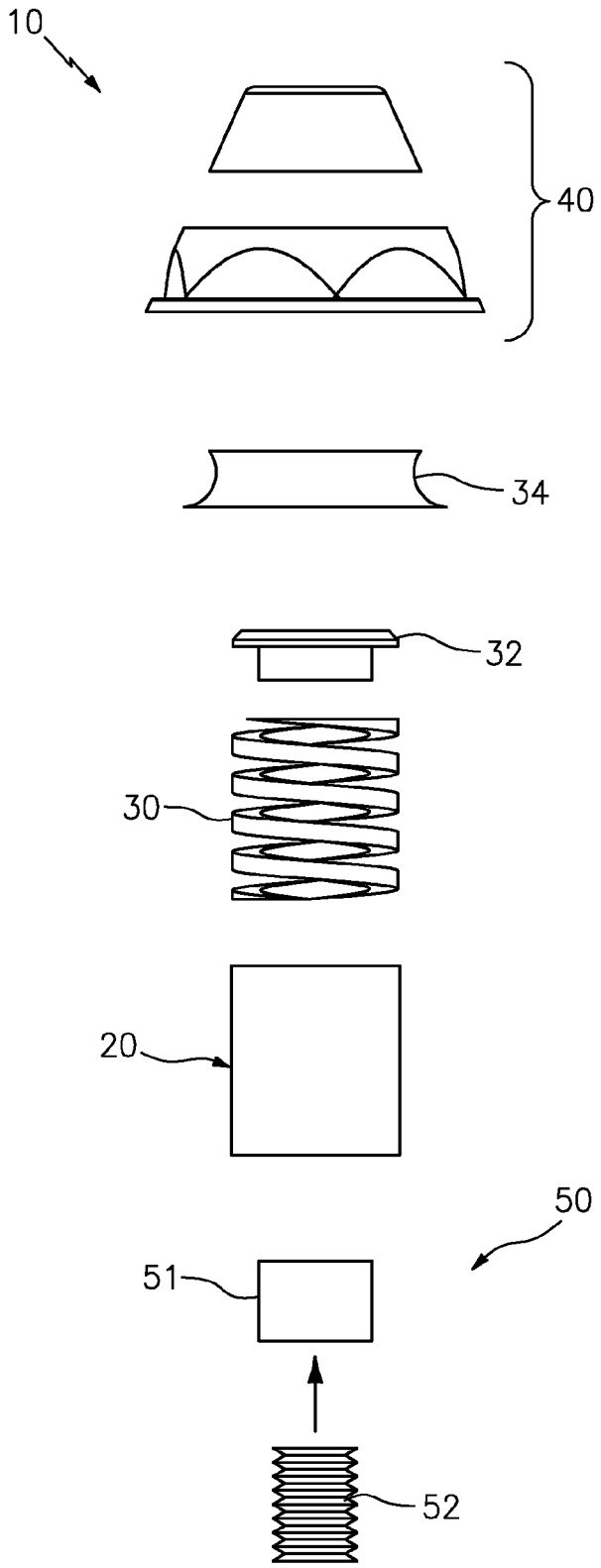
FIGS. 6A and 6B are exploded views applicable to the respective cleat assemblies disclosed herein.
Figure 6B:
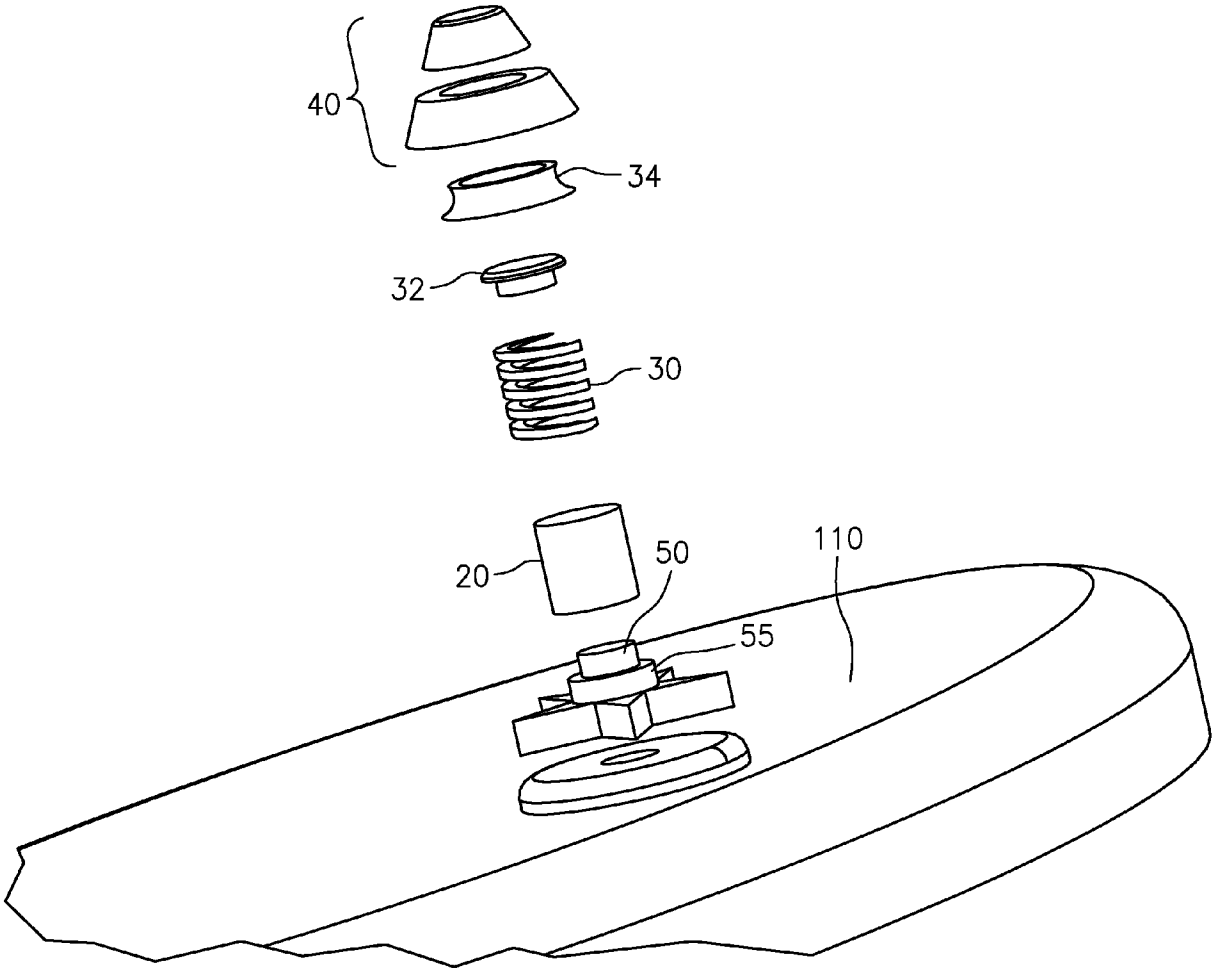

Reference is now made to FIGS. 6A, 6B, which illustrates an exploded view of each of the cleat assembly embodiments illustrated and disclosed herein. Specifically, cleat body 40 may be of a multipart construction, i.e. as many as three (3) or more sections if desired. As illustrated in the figures, cleat body may be of a two part construction, with even a third intermediate section 34 if desired. Preferably, the cleat body is comprised of a flexible material, such as a gel, silicone, rubber and/or polyurethane material.

Figure 3:
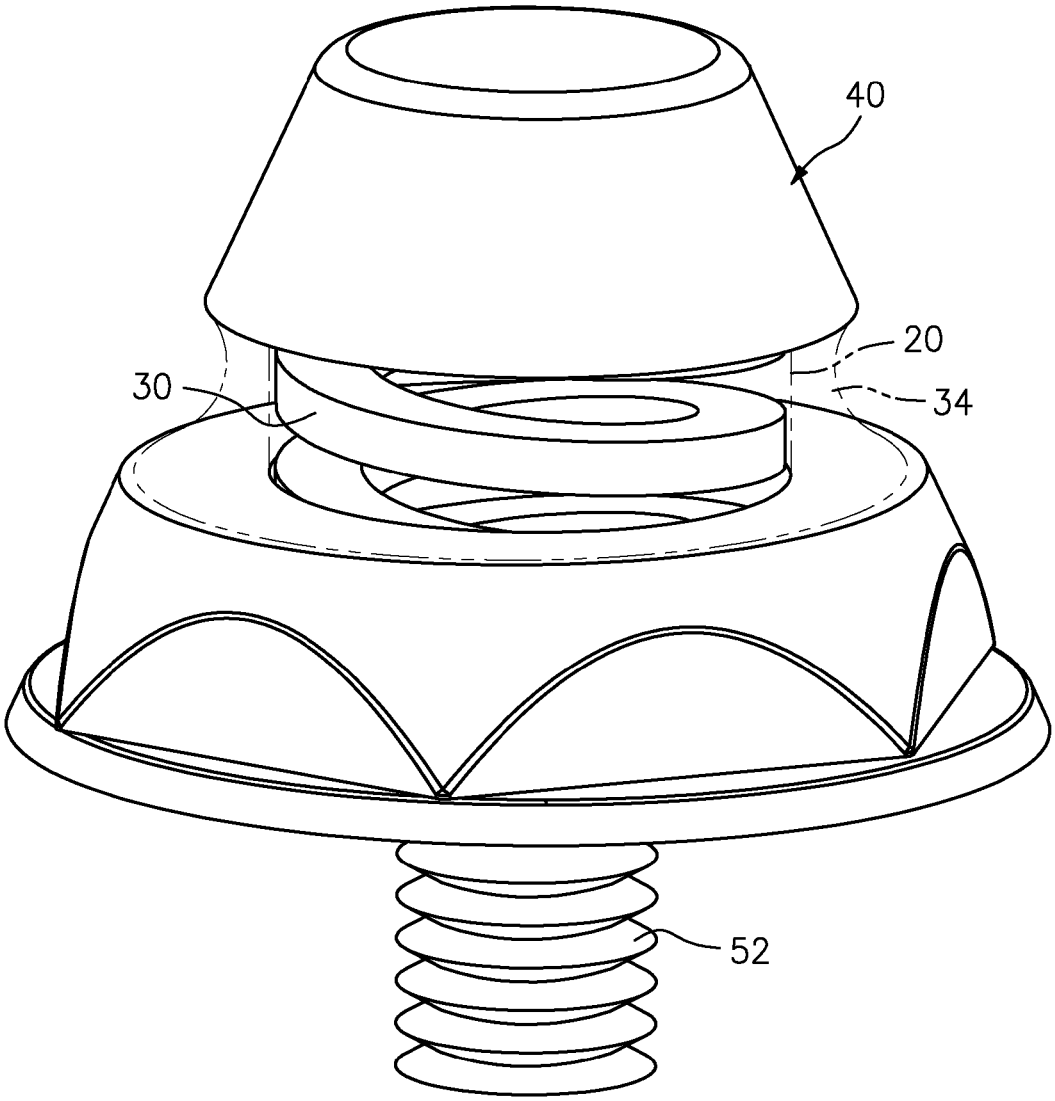
FIG. 3 is a perspective view of the cleat assembly of FIG. 2.

FIGS. 6A, 6B further illustrate the spring 30 and post assembly 20. Spring 30 is disposed over the head 51 of base 50. A cap 32 may be provided to help secure spring 30 relative to post assembly 20. The cleat body 40 is then disposed on the post assembly 20 by overmolding, adhesive or otherwise, as disclosed herein and/or as would be understood in the art. Generally speaking, all of the disclosed embodiments will include a base 50. In the embodiments of FIGS. 2 and 3, base 50 will have a threaded post 52 connected/coupled to base 50. In the embodiments of FIGS. 4 and 5, a post 52 is unnecessary since the cleat assembly is molded to the sole of the shoe.

In a specific embodiment, the post assembly 20 comprises a flexible cover such as a gel, silicone, rubber, polyurethane material or combination thereof. In this way, the biasing member 30 can provide flexibility and thus provides for increased structural support for the post assembly 20. Post assembly 20 may be of a clear material if desired, which will impart a degree of aesthetics aside from the functional advantages as set forth herein.

As should be understood by those skilled in the art and as illustrated in the figures, the post assembly 20 and the cleat body 40 are preferably two separately identifiable structures, with the cleat body 40 being molded or otherwise adhered onto the post assembly. Alternatively, it should also be understood however, that cleat body could be integrally molded with post assembly 20 thereby essentially forming a unitary assembly of the post assembly and cleat body.

Post assembly 20 with spring 30 functions as an absorber of shock and a retractor. That is, the spring 30 stores energy during the force upon it, which may be released upon the foot's pivot or other movement thereby providing force to assist the foot in changing direction. Preferably, the post assembly is comprised of a material selected from the group of rubber, titanium, a polymer blend and/or a combination of any of the foregoing.

As should now be understood, the present invention is also directed to the cleat assembly itself for an athletic shoe comprising an upper portion and a sole, wherein the cleat assembly comprises a base for coupling to the shoe, a post assembly 20 comprising biasing member 30; and cleat body 40, wherein the cleat body 40 is disposed on the post assembly 20; and wherein the post assembly provides for 360° tiltability, relative to the sole; and the cleat body is also tiltable in a 360° direction e.g. 360° tiltability, relative to the sole. That is, the present invention is directed to a shoe with the disclosed cleat assembly and the cleat assembly itself for use with such an athletic shoe.

Advantageously, each cleat body is constructed and arranged to move as a single unit with a slight flex/give to absorb the impact generated by involuntary or voluntary force created by the action of the wearer. Preferably but not necessarily, all the cleats on the shoe incorporate the present invention.

Also advantageously, the present invention can be incorporated into any type of athletic footwear such as for example and not limitation, soccer, football, baseball, golf, rugby, track an or any other sport that the athlete would maximize his or her performance.

The biasing means, i.e. spring 30, is preferably designed so as to permit controlled and/or adjustable tension if preferred, which adds to the inventiveness and control as desired herein. By "adjustable tension" it is meant that differing cleat assemblies can be used by users of differing weights. That is, different users can incorporate different cleat assemblies that are more tailored to that user's weight to optimize performance. In other words, a heavier user may utilize cleat assemblies that have a higher spring coefficient (e.g. thicker spring and/or harder to compress) that that applicable for a more petite/lighter user. This feature of different spring coefficients and/or springs of different size/thickness and/or springiness provides for the customization of the cleat assemblies and/or shoes, which is a feature neither described nor suggested in the prior art, nor found in the market today. That is, utilizing the present invention, shoes and/or cleat assemblies can be customized for maximum performance of a particular user, presumably based at least in part upon the user's weight and athletic needs, including "movement-wise" on the playing surface.

Studies have shown that the weight of the athlete and the force generated by the athlete's movement(s) has a correlation on the biomechanics of the athletes. The results deriving from comparative studies have shown an adaptation by the athlete when performing their pivotal movements to obtain a moment in rotation (torque) according to the force implemented or generated by the body of the athlete based on different size(s) and weight(s).

In reality, the force applied to the ground will depend on the mass of the athlete amplified by the acceleration that his body undergoes at time of contact with the ground. A static 45 kg mass is insufficient to represent this situation. The rotational movement appears after the first peak (braking phase) and before the second peak (starting phase) at the time when the normal force is at its lower level.

As should now be fully understood by the reader, the majority of cleats worn on a natural surface are used to evaluate a surface that does not allow the penetration of the studs on a surface type without infill or another similar product. Such a surface would be classified as too slippery in translation as well in rotation according to some established criteria and methodology. The experience of the majority of the athletes might be to declare that the soles or stud made of soft rubber are a must for surfaces without infill and that the "hard" studs (Teflon, metal, etc) should never be used on these surfaces. The truth is that the athlete is able to choose the stud-material-surface combination to obtain, if he/she so wishes, the same interaction as for natural grass.

As can be seen, the present invention provides for 360 degree flex/tilt with a slight compression to absorb impact. As such, it is advantageous that the cleat body be comprised of a material that will flex/tilt in 360 degrees of direction without becoming deformed, the materials being for example, comprised of gel, silicone, rubber, and/or polyurethane or any other proven material in a shape or form. Importantly, the use of spring 30 in the present invention provides for the customization and calibration of the tilt and force "assistance" (e.g. spring action and/or "push off") that the cleat assembly will provide the user as he steps and/or shifts direction, etc. thereby aiding the user in his foot movements as outlined above. Such calibration and customization, as set forth herein, may be provided in accordance with the user's weight, size, playing surface conditions, etc. to achieve optimal performance by the user.

A preferred tension range should be between 0-300 lbs per inch, depending on the athlete wearing the athletic shoe and the activity or sport being played.

It should also be noted that it would be preferable that the cleat body will be fused together with either titanium, metal, microfiber or any other suitable material.

It can thus be seen that while the cleat body itself may be flexible, the spring inside the post assembly provides for improved flexibility and movement of the cleat body than can be found in the prior art.

It is also to be understood that the following claims are intended to cover all of the generic and specific features of the invention described herein and all statements of the scope of the invention which as a matter of language might fall therebetween.

What we claim is:

1. An athletic shoe comprising:
an upper portion;
a sole; and
at least one cleat assembly comprising a base that is coupleable to the sole, wherein the at least one cleat assembly comprises:
a post assembly comprising a spring; and
a cleat body, wherein the cleat body is formed of a flexible material comprised of a gel, silicone, rubber and/or polyurethane material and is overmolded over the spring and encases the spring;
wherein the post assembly has 360° tiltability, relative to the sole;
wherein the cleat body also has 360° tiltability, relative to the sole, based on the cleat body being disposed on the post assembly; and
wherein the base of the at least one cleat assembly comprises a threaded post, and the at least one cleat assembly is coupled to the sole by the threaded post that threadably engages a complementary receptacle in the sole.

2. The athletic shoe as claimed in claim 1, wherein the base of the at least one cleat assembly is molded to the sole.

3. The athletic shoe as claimed in claim 1, wherein the post assembly is comprised of a material selected from the group of rubber, titanium, a polymer blend and/or a combination of any of the foregoing.

4. The athletic shoe as claimed in claim 1, including a cushion member disposed between the at least one cleat assembly and the sole of the shoe.

5. A cleat assembly comprising a base that is coupleable to a sole of an athletic shoe comprising an upper portion and the sole, wherein the cleat assembly comprises:
a post assembly comprising a spring; and
a cleat body, wherein the cleat body is formed of a flexible material comprised of a gel, silicone, rubber and/or polyurethane material and is overmolded over the spring and encases the spring; and
wherein the post assembly has 360° tiltability relative to the sole of the athletic shoe when coupled thereto; and
wherein the cleat body also has 360° tiltability, relative to the sole based on the cleat body being disposed on the post assembly; and
wherein the cleat assembly comprises a thread post, and the cleat assembly is coupled to the sole by the threaded post that threadably engages a complementary receptacle in the sole.

6. An athletic shoe comprising:
an upper portion;
a sole; and
at least one cleat assembly comprising a base that is coupleable to the sole, wherein the cleat assembly comprises:
a post assembly comprising a spring; and
a cleat body, wherein the cleat body is formed of a flexible material comprised of a gel, silicone, rubber and/or polyurethane material and is overmolded over the spring and encases the spring;
wherein the cleat body is moveable vertically relative to the sole of the shoe and also tiltable relative to the sole; and
wherein the at least one cleat assembly comprises a threaded post, and the at least one cleat assembly is coupled to the sole by the threaded post that threadably engages a complementary receptacle in the sole.

* * * * *